United States Patent [19]

Hagen

[11] Patent Number: 4,622,832

[45] **Date of Patent: * Nov. 18, 1986**

[54] ICE MAKING MACHINE

[75] Inventor: William F. Hagen, Argyle, Tex.

[73] Assignee: Turbo Refrigerating Company, Denton, Tex.

[ * ] Notice: The portion of the term of this patent subsequent to Jul. 30, 2002 has been disclaimed.

[21] Appl. No.: 736,455

[22] Filed: Jun. 24, 1985

Related U.S. Application Data

[62] Division of Ser. No. 569,614, Jan. 10, 1985, Pat. No. 4,531,380.

[51] Int. Cl.[4] ..... F25C 5/10

[52] U.S. Cl. ..... 62/344; 62/352

[58] Field of Search ..... 62/320, 344, 347, 348, 62/352; 165/156; 193/14; 198/360; 225/4, 97, 103; 241/DIG. 17, 266

[56] References Cited

U.S. PATENT DOCUMENTS

| | | | |
|---|---|---|---|
| 2,123,827 | 7/1938 | Eyrick et al. | 241/266 X |
| 2,387,899 | 10/1945 | Gruner | 62/352 |
| 2,549,747 | 4/1951 | Leeson | 62/348 X |
| 2,598,430 | 5/1952 | Pownall | 62/320 X |
| 2,657,547 | 11/1953 | Heuser | 62/347 X |
| 2,663,162 | 12/1953 | Trepaud | 62/347 X |
| 2,721,452 | 10/1955 | Brandin et al. | 62/347 X |
| 2,867,068 | 1/1959 | Dumanowski | 198/360 X |
| 2,937,508 | 5/1960 | Garland | 62/344 X |
| 2,949,752 | 8/1960 | Bayston | 62/348 X |
| 3,759,061 | 9/1973 | Nilsson et al. | 62/348 X |
| 3,791,163 | 2/1974 | Dickson et al. | 62/352 X |
| 3,913,374 | 10/1975 | Esser et al. | 225/103 X |
| 4,364,754 | 12/1982 | Diachuk | 165/156 X |

*Primary Examiner*—William E. Tapolcai
*Attorney, Agent, or Firm*—Fred Wiviott

[57] ABSTRACT

A machine for manufacturing ice including a plurality of elongated vertical tubes of uniform internal cross-sectional dimensions, a cylindrical shell for each tube of length less than the tube and surrounding a substantial portion of the length of the tube, the internal nominal diameter of the shell being greater than the maximum external cross-section dimensions of the tube, the shell having a spiral groove formed in the cylindrical wall thereof, the depth of the groove being such that the interior surface of the shell at the groove contacts at least part of the exterior surface of the tube thereby forming a flow path in the annular area between the exterior of the tube and the interior of the shell which is, at least in part, spiraled. Refrigerant gas is expanded in the tube-shell annular areas to chill the tubes. Water is introduced into the upper end of the tubes to flow downwardly through them and form in each tube a rod of ice. The tubes are then heated, such as by introducing hot gas into the annular tube-shell area to release the rods of ice which falls downwardly out the lower end of the tubes, the annular refrigerant flow path providing improved effectiveness and efficiency in chilling the tube for the formation of ice. Pivotally actuated cutter sever the rods of ice into short lengths. A diverter arrangements directs water flowing out of the tubes as ice is being formed into a reservoir and shifts to direct the produced ice out of the machine.

9 Claims, 15 Drawing Figures

ICE MAKING MACHINE

This is a division of application Ser. No. 569,614, filed Jan. 10, 1985, now U.S. Pat. No. 4,531,380.

SUMMARY OF THE INVENTION

This invention relates to the design of an ice making machine and in particular to an ice making machine which produces regular size pieces of ice.

The primary areas of attention in an efficient ice making machine are as follows:

A. The evaporator or surface on which the ice is formed;

B. The method of releasing the ice from this surface;

C. The means, if any, of cutting the ice into pieces of the desired size; and

D. The means of separating the water path during ice making from the exit paths of the harvested ice.

This invention addresses all of these areas and discloses substantial improvements in all of these areas.

Addressing each area in sequence:

A. Evaporator

One of the common ways of producing regularly sized ice in two dimensions is to freeze the ice on the inside of a tube. The tube or tubes are arranged vertically. Water is allowed to flow down the inside of the tube. The tubes are enclosed in a larger vertical cylinder or shell.

Refrigerant is admitted to the volume inside the shell and outside the tubes by conventional well known methods. For practical reasons the refrigerant chamber is relatively large. The amount of refrigerant required to contact the outer surface of the tubes is large and in the presently used methods there is no exactly directed path of the refrigerant relative to the outer surface of the tube.

In this invention the ice making surface is the inner surface of a tube preferably a square tube but the tube can be of any cross-sectional shape. The inner tube is placed inside a larger cylindrical tube.

In the case of a square inner tube, the inside diameter of the outer tube is greater than the diameter of a circle which would just circumscribe the square tube. The outer tube is provided with helical grooves that deform both the inside and outside diameter of the outer tube so that the inside diameter of the outer tube in the grooved region is in direct contact with the outside corners of the square inner tube. In this manner passages are formed between the outside surface of the inner tube and the inside surface of the outer tube. In the case of the square inner tube there are four segments of the circle bounded by the circumference of the inside of the outer tube and the four sides of the outer surface of the inner tube, plus the helical passage between the circumference of the inside of the outer tube and the outside corners of inner tube in the ungrooved portions of the outer tube. In the grooved portion of the outer tube the inside circumference of the outer tube is in direct contact with the outer four corners of the inner tube. In this manner all four segments are interconnected.

By proper choice of relative dimensions of the inner and outer tube and of groove depth and pitch, a passage for refrigerant is provided that will produce a velocity of refrigerant consistant with good heat transfer.

In the inner tube is cylindrical, the relationship between the outside diameter of the inner tube and the inside diameter of the outer tube and the groove depth and pitch is so chosen that the resulting helical annular passage formed when the inside diameter of the outer tube is deformed at the bottoms of the grooves to contact the outer surface of the inner tube is of such dimensions as to provide refrigerant velocities consistant with good heat transfer.

By this construction in all cases the following advantages are obtained:

1. A directed refrigerant path with improved heat transfer.
2. A reduced refrigerant charge. (Fewer pounds of refrigerant per unit length of tube.)
3. Increased strength and rigidity of both inner and outer tubes. The straightness of the inner tube is critical, for if the inner tube is bent, uneven, or deformed, on harvest the ice must be melted down to permit the finished ice rod to fall free of the inner tube.

B. Method of Releasing Ice from Inner Tube after Freezing of the Ice on the Inside Surface of the Inner Tube The rod of ice, solid or containing a round hole in the center, must be released from the evaporator surface. There are two conventional methods of releasing ice, that is, (a) hot gas, or (b) water.

The evaporater construction described above allows the use of either or both. Water defrost is a very effective and efficient method when the supply water temperature is high, i.e. greater than 65° F. (18° C.) and the demand for ice is related generally to ambient temperature. When the supply water temperature is substantially below the above figures, water defrost loses its advantage. When the supply water drops to or below 40° F. (4° C.) water defrost becomes a disadvantage.

Water defrost can be achieved with the evaporator construction described above by installing near the top of the tubes a water distributing header which will, on defrost, allow supply water to be sprayed on the outside of the outer tubes. The water runs a short distance down each tube where it encounters a weir (such as an O-ring around the outside of the outer tube). This weir causes the water to distribute itself uniformly around the circumference of the outer tube. The water then flows uniformly with a swirling action induced by the helical grooves in outer tube down the length of the outside tube. If the supply water temperature is high then there is considerable heat transfer between the supply water and the evaporator. This aids in the release of the ice from the evaporator and if the supply water leaving the evaporator is retained it reduces the temperature of the water to next to be frozen.

Hot gas defrost is accomplished in the conventional manner by introducing high pressure superheated refrigerant vapor into the evaporator. Because of the construction of the evaporator there is at the initiation of the harvest a relatively small amount of refrigerant in the evaporator which must be raised in temperature by the hot gas. For this reason the effect of the hot gas is felt more quickly, reducing the time required for harvest and thereby increasing the number of freezing cycles and the ice output of the ice making machine.

By using water and hot gas in varying proportions the most efficient harvesting means for any supply temperature can be obtained. This is a unique feature and benefit of the evaporator construction.

C. Means of Cutting into Regular Lengths

The ice issuing from the above described evaporator on harvest is in the form of a rod of ice whose cross-section conforms in shape (but slightly smaller in dimensions) to the internal cross-section of the inner tube. The rods of ice when released from the evaporator slide or fall vertically downward by gravity.

If there is located below the evaporator a mechanism which will allow each rod of ice to fall a certain distance, then be held and subsequently the rod of ice encounters a pinching action, the rod of ice will fracture cleanly in the plane of the pinching action provided the pinching surfaces are sharp.

This action can be achieved by a series of oscilating cutters which have at their upper extremity sharp cutting edges similar to knives. As the oscillator opens the top edge of the cutters, the rod of ice drops between the cutting edges and rests on inward tapering surfaces. As the cutters oscillate back to the cutting position the rod of ice is drawn deeper as the inward tapering surfaces rotate into a more nearly vertical and parallel positions. At a certain instant the sharp edges pinch the rod of ice causing the ice rod to fracture along a horizontal plane.

The remaining rod of ice cannot enter into the cutters since the cutting edges are too close together and are rotating toward each other. At the same time the rotation causes the previous inward tapering surfaces to become parallel or even outward tapering. At this point the cut rod or cube falls out in a downward direction. The direction of rotation is then reversed and the top cutting edges rotate away from each other and when the edges are open enough the rod of ice drops between the cutting edges onto the now inward tapering surfaces.

A mechanism similar to the one described above is the subject of a patent application by John McNeil of Victoria, Tex. However, the McNeil device uses a cutter construction that has essentially an "I" shaped cross-section which causes the cut cube to be trapped in the cavity between the bottom horizontal member and the vertical member of the "I". The trapped cube prevents the admission of the ice rod into the cutter. Experience shows that the cutting time with the "I" shaped member is much longer than with the construction of this invention.

D. Separating the Water and Ice Paths

From the above it can be seen that on harvest, the cut cubes drop vertically downward by gravity from the cutter. Generally it is not desireable to have the ice exit directly beneath the ice machine. Accordingly, the cubes fall onto an inclined slide and exit from the machine at one side.

During the ice making cycle water is run down the inside of the inner tube and frozen into ice. However not all of the water is frozen at once with the consequence that some appreciable amount of water flows out the bottom of the tubes. It can be appreciated that the water falling by gravity would follow the same path as the cut cube and would strike the slide and run out of the machine instead of returning to the water sump to be recirculated. Of course, the slide could be perforated or made of wires parallel to the pitch of the slide to attempt to have the water pass through the slide and still retain the ice on the slide. However, experience shows that while devices of this nature permit the return of the majority of the water to the sump an annoyingly large amount of water, by clinging or splashing exits from the machine. Additionally there can be an infiltration of warm air into the machine via the ice escape path which reduces the efficiency of the machine. Therefore it is desirable to have two different paths; one for ice exit during harvest, and one for positive direction of the water back to the sump during the freezing cycle which closes off direct contact with the outside ambient.

These goals are accomplished in the present invention by pivoting a section of the ice slide so that during harvest the ice slide is a plane inclined downward to the outside edge of the machine, and during freezing the pivoted section is inclined in the opposite direction so that the direct path to the outside is closed and the water is positively directed back to the sump.

Obviously there must be a moving force applied to pivot the slide section and the timing of the movement must be such that the slide is in the "up" position prior to the water issuing from the tubes and in the "down" position prior to the issuing of the cubes from the cutters. It is not desireable to add additional moving devices. Further since at the end of the harvest cycle, the slide must move to the "up" position rapidly, while at the end of the freezing cycle it will be 30 seconds to one minute before the first ice is released from the inner tubes.

All of these objectives are met in the following manner. Note that the circulating water pump which takes water from the water sump and delivers it to the top of the inner tubes runs only during the freezing cycle. Therefore, the pivoted section is unbalanced so that it is in equilibrium in the "down" portion, that is, ice discharge position. On the underside of the pivotal section on the lighter side of the pivot point, is a large reservoir pipe of such dimensions that when this pipe is full of water the weight of the water causes an over balance and the pivoted section moves to the "up" position. The reservoir is incorporated into the water circulating line by flexible hoses in a manner such that water from the discharge of the circulating pump enters the reservoir from the bottom side and exits from the top side.

By means of this arrangement, at the start of the freezing cycle, when the circulating pump starts, the reservoir on the pivot section must become full of water before any water reaches the top of the tubes. Hence the water pump is used as the power source to pivot the slide section and the timing of the pivoting is positively controlled. When the freezing cycle is over, the water pump is stopped and the water in the entire circulating line allowed to drain back into the sump. The loss of the weight of water in the pipe attached to the pivot section of the slide causes the pivot section to rebalance itself in the down position.

The invention will be better understood with reference to the following drawing and description of the preferred embodiment.

DESCRIPTION OF THE DRAWINGS

FIG. 2 shows the lower portion of the machine in the mode during which ice is being discharged from the machine.

DETAILED DESCRIPTION OF THE PREFERRED EMBODIMENT

Figure 1:
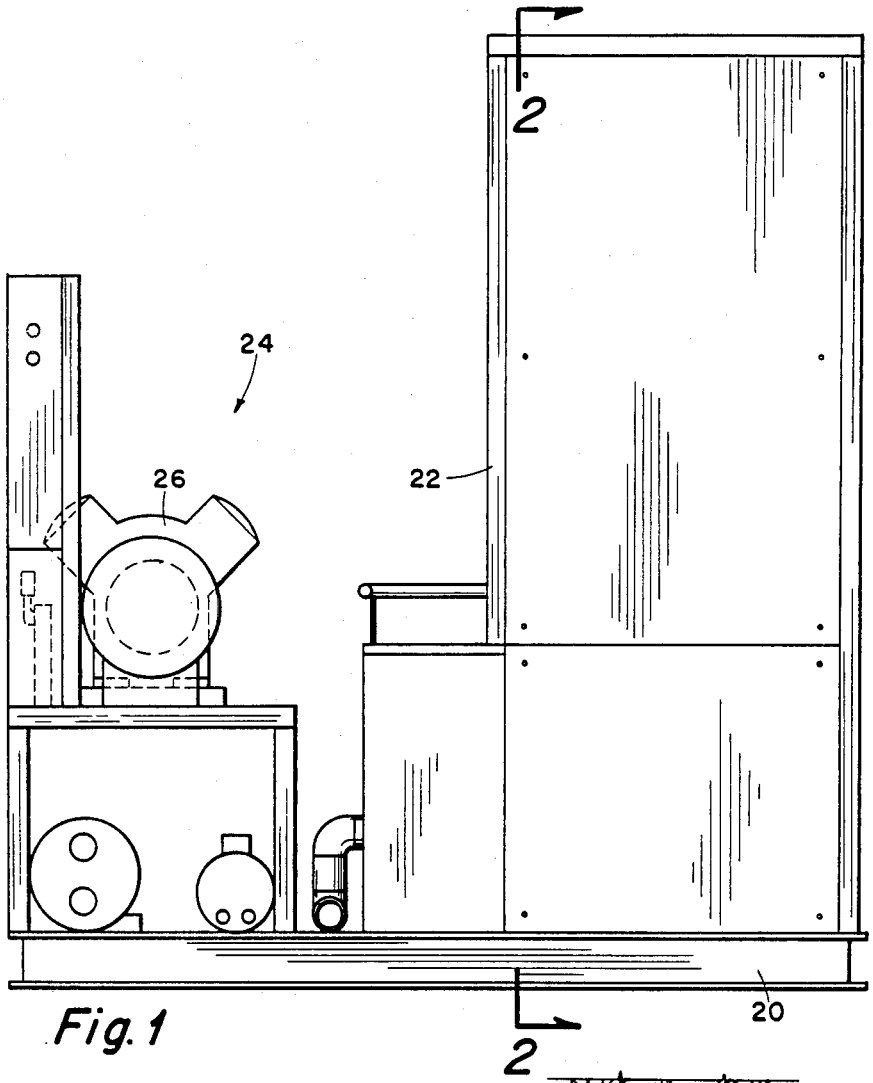
FIG. 1 is an elevational exterior front view of an ice making machine which embodies the principles of this invention for manufacturing small discreet cubes of ice.

Referring to the drawings and first to FIG. 1, an ice making machine illustrative of the type which employs the principles of the invention is shown. The machine includes a base 20 which may be of any type of structural arrangement. Mounted on the base is a housing 22 which encompases the ice making mechanism. The housing 22 is typically closed but access to the interior is provided by doors, panels and the like. To conserve energy the housing 22 is preferably insulated. Positioned on the base 20 adjacent housing 22 is a refrigeration mechanism generally indicated by the numeral 24 which is of the usual type including a compressor 26 for compressing refrigerant gas in the typical compression-/expansion refrigeration system. Since the refrigeration system 24 is standard, it will not be described in further detail, it being understood that any system for delivering compressed refrigerant gas which can be allowed to expand for extraction of heat can function in the ice making system of this invention.

Figure 2:
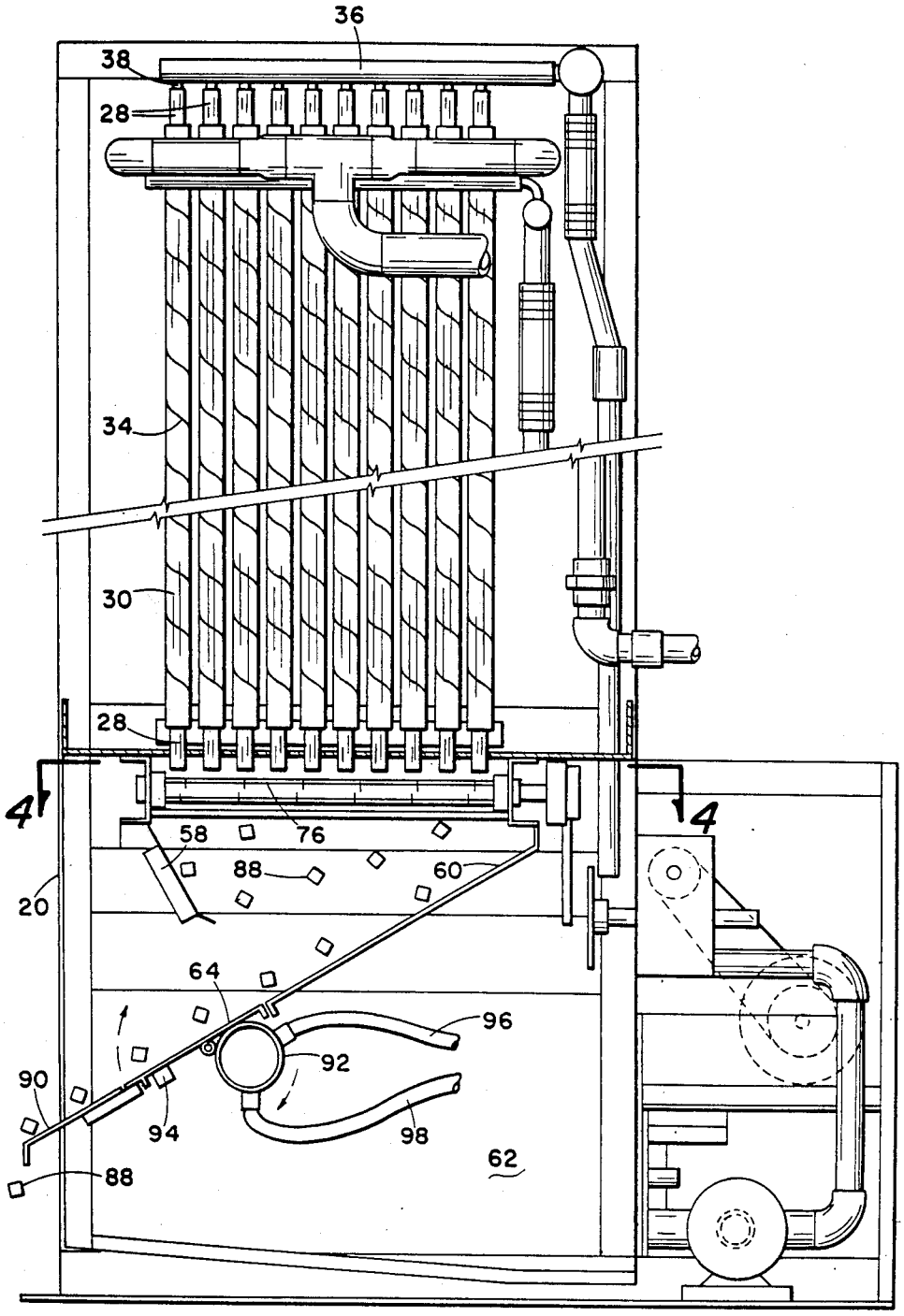
FIG. 2 is an elevational interior view of the major components of the ice making machine as taken along the line 2—2 of FIG. 1.

FIG. 2 shows some of the details of the internal arrangement of the ice making machine. The machine to be illustrated is, by way of example, of the type which produces small discreet cubes of ice. The dimensions of the cubes may be any desired but may typically be approximately ½" to ¾" width and heighth. The machine which fulfills the objectives of the inventions may produce discreet cylindrical chunks of ice or the ice may be of rectangular cross-sectional configuration. For practical purposes the two basic types of ice preferably produced by the ice making machines are cubes of ice having square cross-sectional configuration and of length which can be equal to or which can be more or less than the width of the ice formed in the machine or, the second basic primary type of ice produced by the system of this invention consists of cylinders of ice of discreet length.

Figure 5:
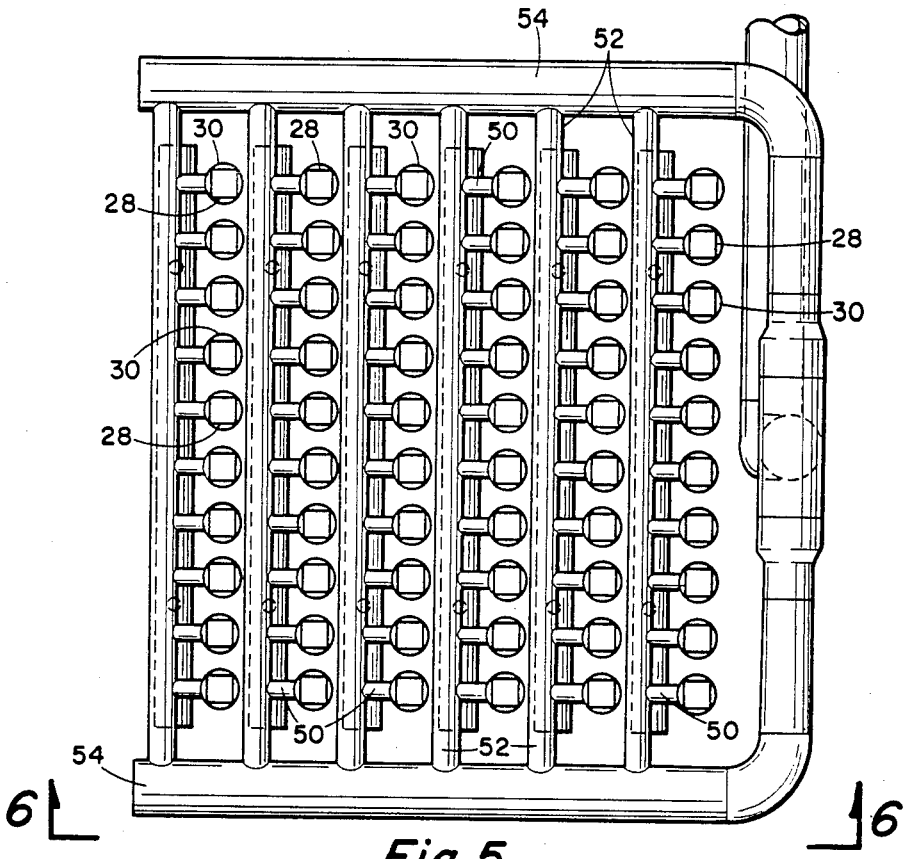
FIG. 5 is a cross-sectional view taken along the line 5—5 of FIG. 3 showing the upper portion of the tubes and showing the method of piping for distribution of refrigerant and hot gas in the shell-tube annular areas.

For forming the ice a plurality of elongated vertical tubes 28 are employed. In the illustrated embodiment of the invention, sixty such tubes 28 are used. The tubes are arranged in rows and columns as best illustrated in FIG. 5. The invention will be described wherein the tubes 28 are of square cross-sectional configuration it being understood, as previously indicated, that the tubes 28 may of round, rectangular, or other cross-sectional configurations, however the square and round configurations are preferred. The tubes 28 are straight and vertical. The tubes are open at the top and the bottom and are preferably formed of stainless steel or other metal having good heat conducting characteristics and resistance to rust and corrosion.

Surrounding each of the tubes 28 is a shell 30 which is closed at the top and bottom against the tubes 28 so that a closed annular area 32 is provided between the interior surface of shell 30 and tube 28. These annular area 32 form expansion chambers in the refrigeration system.

Figure 11:
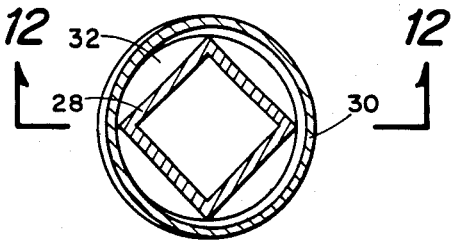
FIG. 11 is a cross-sectional view of a shell and tube wherein the tube is of square cross-sectional arrangement as used to produce small cubes of ice and showing the contact of the spiraled wall of the shell with the corners of the tube.

An important aspect of the invention is the specific configuration of each of the shells 30 and tubes 28 to form specifically configured annular expansion areas 32. For this purpose, the shells 30 are configured to have formed in the wall thereof a spiral groove 34 as seen particularly in FIGS. 11, 12 and 13. The tubes 28 have an maximum external dimension which is less than the nominal internal dimension of shell 30. When the tube is square as shown in FIG. 11, this means that the internal diameter of shell 30 is nominally greater than the external diametrical measurement of the tube. When the tube 28 is cylindrical it means that the internal diameter of the shell is greater than the external cylindrical diameter of the tube.

The spiral groove 34 formed in the wall of each shell 30 is of such depth that the internal cylindrical surface formed by the spiral is dimensioned to engage the exterior of tube 28. Thus the tube 28 is in contact with the wall of shell 30 where the tube contacts spiral groove 34.

Figure 12:
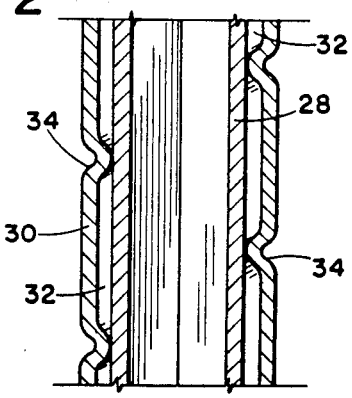
FIG. 12 is a short elevational cross-sectional view showing the relationship between a spiraled shell and a square tube.
Figure 13:
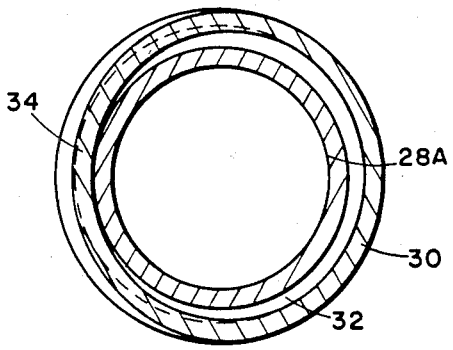
FIG. 13 is a cross-sectional view as in FIG. 11 but showing the arrangement wherein the ice making tube is cylindrical rather than square, and showing the contact of the interior spiraled wall of the shell with the tube exterior cylindrical surface.

In this way the annular expansion chamber 32 is, at least in part of spiral configuration. Where the tube is circular, designated by the numeral 28A in FIG. 13, the expansion chamber is totally spiral throughout the length of the spiraled portion of shell 30. When the tube 28 is square in cross-section as shown in FIGS. 11 and 12 the annular expansion chamber 32 is only partially spiral in that there is provision for gas to pass vertically along the adjacent side walls of the exterior of the tube since the spiral contacts the tube only at the corners. In either event, the provision of the spiral groove 34 in shell 30 causes refrigerant gas to take a contorted path as it traverses the length of the shell.

Figure 3:
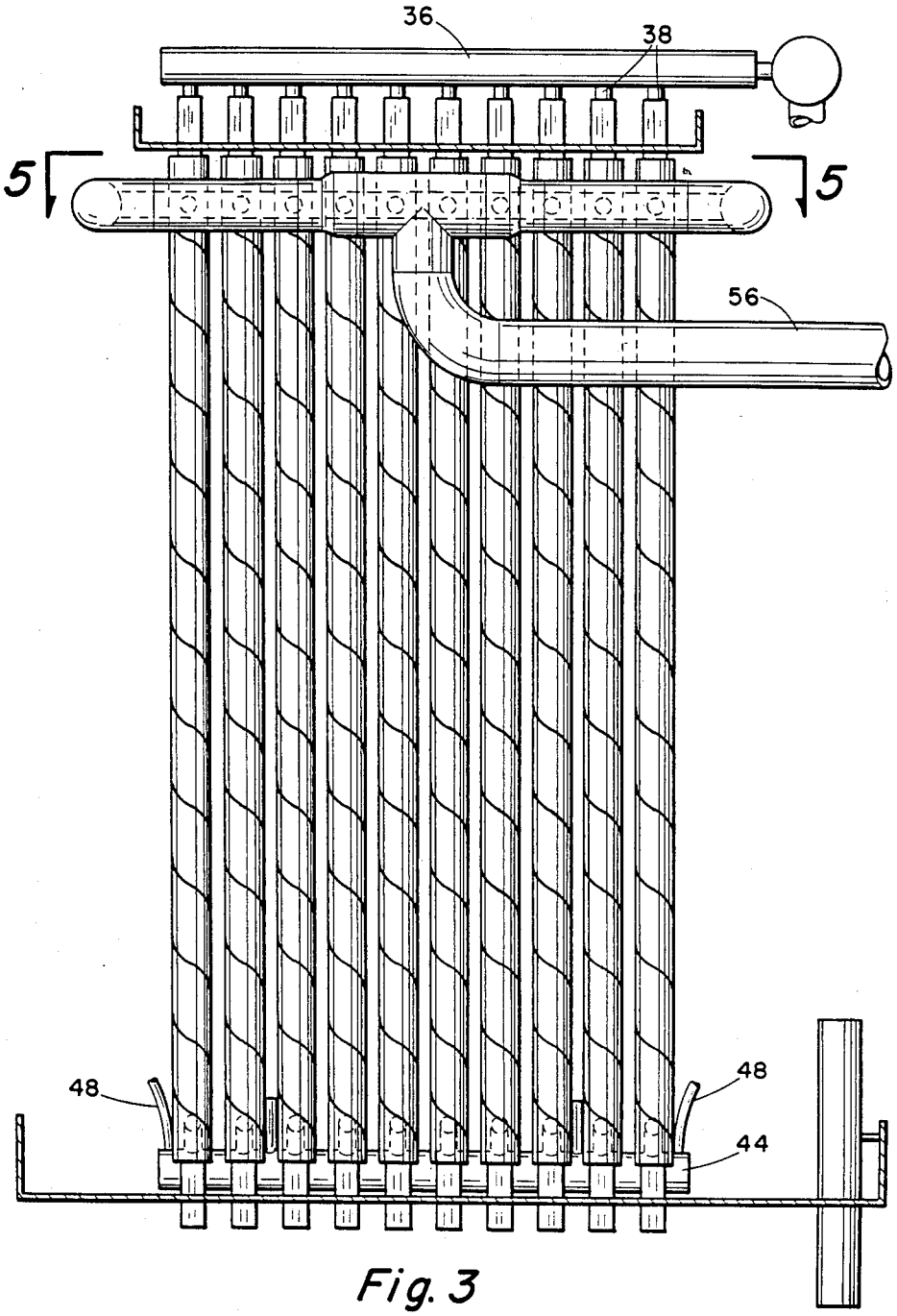
FIG. 3 is an enlarged elevational view of the upper portion of the ice making machine as shown in FIG. 2 showing the spiraled shells surrounding the tubes.
Figure 3A:
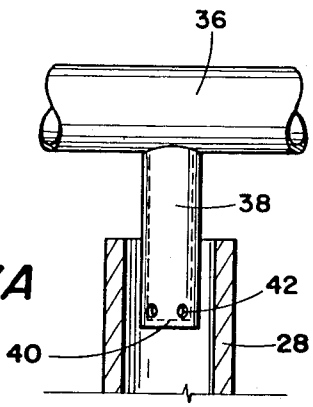
FIG. 3A is an enlarged cross-sectional view of the upper portion of the tube showing the water injection nozzle extending in it and showing the arrangement so that the water injection nozzle causes the water to impinge on the interior sidewall of the tube.

Water is injected into the upper ends of the tubes 28 from a manifold 36. (See FIGS. 3 and 3A.) Connected with the manifold is, for each tube, a short down spout 38 which is closed at the lower end 40. Adjacent the closed end 40 are a number of spaced small diameter holes 42. Water injected from the manifold 36 passes through the small holes 32 and therefore sprays onto the interior wall of each tube 28.

Figure 6:
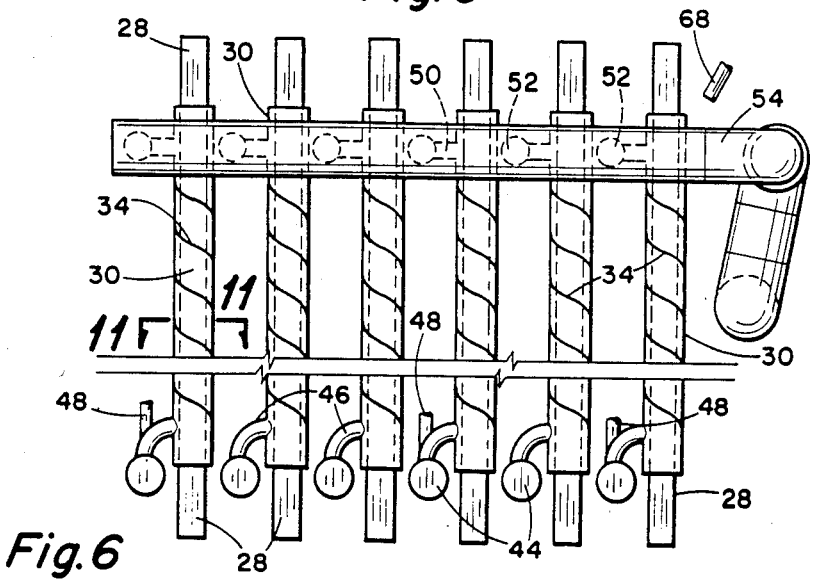
FIG. 6 is an enlarged, fragmentary view, taken along the line 6—6 of FIG. 5, and showing the arrangement of the refrigerant and gas distribution system.

With the refrigeration system functioning, compressed gas is fed from a gas distribution manifold 44 and by small conduits 46 into the lower end of each of the shells 30. More specifically, by means of distributor conduits 48 gas is received from an expansion valve in the refrigeration system and passes from the manifolds 44 and conduits 46 into the lower end of shell 30. The gas passes upwardly, expanding, and absorbing heat from the tubes 28. At the top of each of the shells is a small conduit 50 which connects to a return pipe 52 which in turn connects to return headers 54 as shown in FIGS. 5 and 6. The distribution conduits 48 and refrigerant return pipe 56 connect to the refrigeration system indicated generally by the numeral 24.

The ice making machine of this invention works on a cycle process. Rods of ice are frozen simultaneously in each of the sixty tubes 28 by the expansion of refrigerant gas within the annular expansion chambers 32. Upon completion of a timed cycle, after which each of the tubes 28 is filled, or at least substantially filled with ice, the discharge cycle starts. Ideally, the cycle is such that upon completion, only small diameter passageway remains in the interior of each rod of ice formed. While the ice is being formed water flows downwardly through each of the tubes and is conducted, by plates 58 and 60 (see FIG. 2A) into the lower water collection chamber 62 formed in the lower portion of housing 20. To insure that the water flowing out of the lower ends of the tubes flows into the collection chamber 20, a baffle 64 is employed which is pivoted about a horizontal axis 66. In the mode shown in FIG. 2A which is during the freezing cycle, baffle 64 is tilted so that water falling downwardly from the lower ends of the tubes passes into the chamber 62. The method of pivoting the baffle 64 will be described subsequently.

At the end of the timed cycle with ice formed in tubes 28, the harvest cycle begins. This is accomplished by terminating the discharge of refrigeration gas into the expansion annular areas 32 and by applying heat to tubes 28. There are two basic means of applying heat to the tubes. The preferred arrangement is to circulate hot gas in the annular areas 32. This causes the temperature of the tubes 28 to rise above the freezing point of water which releases the hold on the rods of ice formed within each of the tubes. Since the tubes are vertical, the rods of ice wall fall downwardly out the lower opened end of each of the tubes.

Another means of heating the tubes is by spraying water onto the exterior surface of shells 30. This may be accomplished by providing a small water jet 68 adjacent the top of each shell. FIG. 6 shows a water jet 68 and when the water heating system is employed there will be a jet 68 for each of the shells 30. Water flowing on the outside of the shells serves to heat the shells and since the shells are in thermal contact with the tubes, by the effect of grooves 34 formed in the shells, heat is conducted to the tubes to raise the surface temperature above freezing, allowing the rods of ice to fall out the lower ends of the tubes.

While either of these methods of heating tubes 28 may be employed, another arrangement includes the use of the combination of both. In practicing this method, the quantity of water necessary to produce one sequence of ice in the sixty tubes is injected through water jet 68 while at the same time hot gas is passed through the refrigeration piping to flow in the annular areas 32. The water passing over the exterior of the shells will flow downwardly into the collection chamber 22. Thus the heat absorbed by the water to warm the tubes 28 serves to cool the water so that this energy is conserved. Since the amount of heat which may be extracted from the water is proportional to the water temperature it may be necessary in most cases that additional heat be provided by means of hot gas. It has been learned that when the water temperature approaches 65° F. sufficient heat can be obtained from the water to affect the heating cycle necessary to cause harvest of the ice. When the inlet water temperature is below 40° F. it contributes very little to the release of the ice from the tubes and therefore discharging the required make up water directly into the reservoir 62 is the best procedure.

Figure 7:
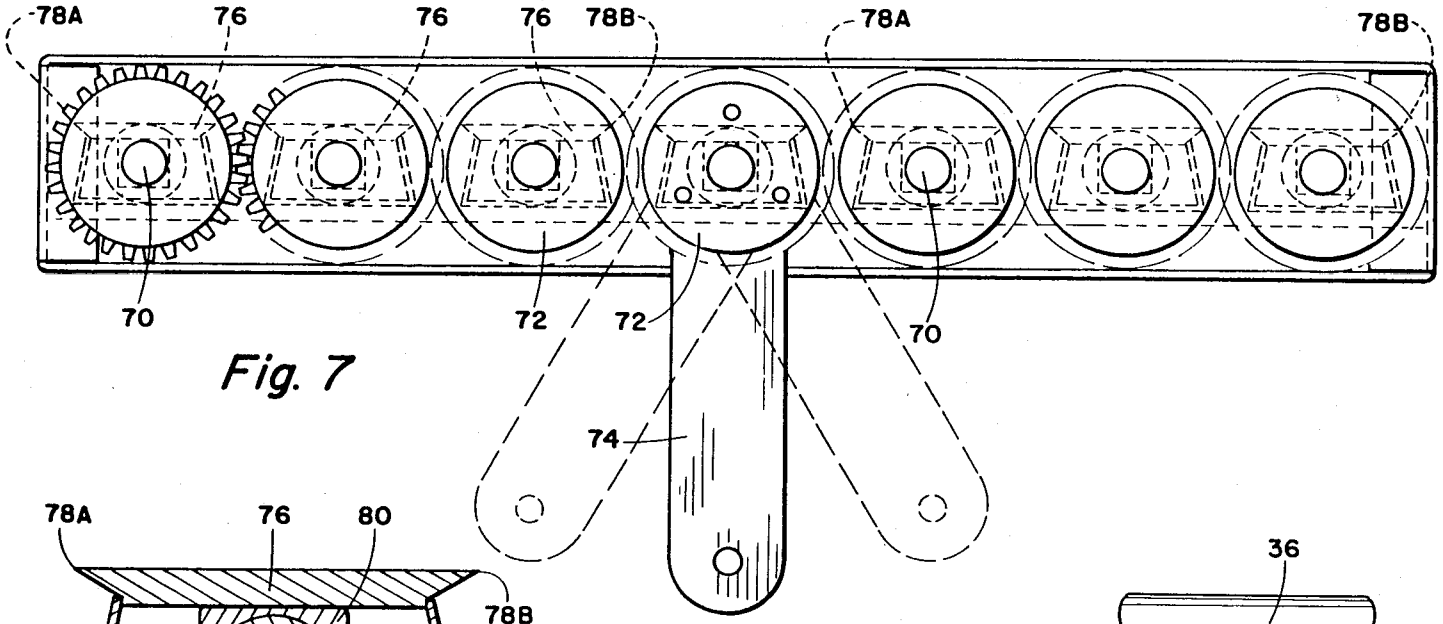
FIG. 7 is an end view of the cutter arrangement of the invention showing the gears used for cutting the rods of ice into uniform lengths.
Figure 4:
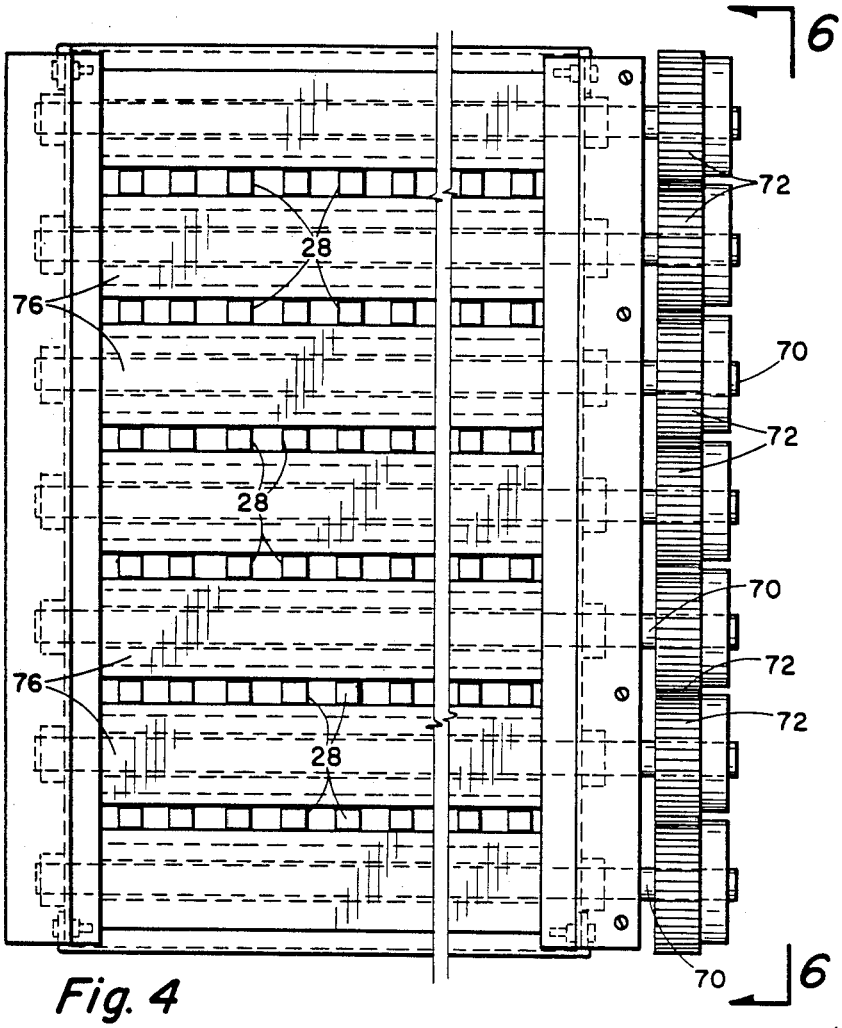
FIG. 4 is a plan, cross-sectional view, taken along the line 4—4 of FIG. 2 showing the arrangement of the cutters.

In any event, the tubes are heated so that the rods of ice fall downwardly. In order to produce ice acceptable to the purchasing public it is desireable that the ice be formed into discreet chunks and, as previously indicated, by the processes of this invention the chunks are preferably cubes or cylinders. The cutting operation will be understood by reference to FIGS. 4 and 7, with greater details provided in FIGS. 8, 9 and 10. Positioned below the lower end of the tubes are seven shafts 70 which are parallel to each other and horizontal. The number of shafts is one greater than the number of rows of tubes 28. The shafts 70 are spaced between the rows of tubes and each shaft has mounted on one end thereof, a gear 72. The gears mesh with each other as shown in FIG. 7 so that the shafts rotate cocurrently with alternate shafts rotating in opposite direction. Affixed to one of the gears 72 is a crank arm 74 which, during ice harvesting, is reciprocated back and forth approximately a total of 60°. The drive mechanism for reciprocation of the crank arm 74 is not shown since it is of standard construction such as an electric motor with a crank shaft and connecting rod extending from it which is affixed to the lower end of the crank arm 74. When such motor is actuated it runs continuously during the harvesting cycle to constantly reciprocate the shaft 74. Since the harvesting of the ice takes only a minute or two, the motor which reciprocates the crank arm 74 need only run for this portion of each ice making cycle.

Figure 8:
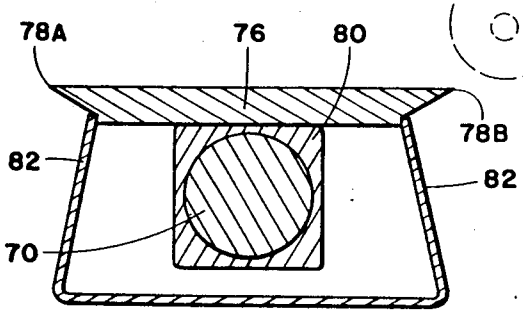
FIG. 8 is an enlarged cross-sectional view of a cutter.

To each of the shafts 70 a cutter blade 76 is attached. Each cutter blade has opposed cutting edges 78A and 78B. Each cutter blade is affixed to a block 80 by which it is secured to shaft 70. Tapered cutter guides 82 are affixed to each blade along and adjacent to the cutting edges 78A and 78B. In the illustrated arrangement as shown in FIG. 8 the cutter guides are formed of a unitary steel plate bent with the upper edges welded to the cutter blade 76. The cutter guides 82 are planar so as not to impede the passage of ice therepast unless they are oriented in such a way as to intercept the ice.

Figure 9:
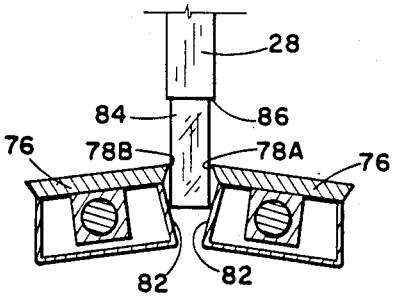
FIG. 9 illustrates two adjacent cutters showing the first mode in which a rod of ice extends downwardly from a tube between adjacent cutters which are opened to receive the rod of ice.
Figure 10:
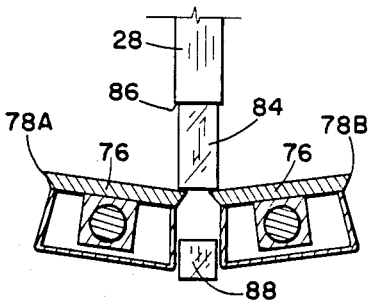
FIG. 10 shows the relationship of the cutters when they have been oscillated to sever the ice into a discreet chip, such as a cube or a cylinder.

FIGS. 9 and 10 show the sequence of cutter operation. Tube 28 has been heated so that a rod of ice 84 falls downwardly by gravity out of the tube lower end 86. The rod of ice 84 has a cross-sectional configuration substantially equal to and just slightly smaller than the internal cross-section of tube 28 and therefore, when tube 28 is of square cross-section the rod of ice 84 is also of square cross-section. FIG. 9 shows the adjacent cutter blade 76 tilted so that the edges 78B and 78A are spread apart allowing the passage of the rod of ice 84 therepast. However, the planar cutter guides 82 affixed to each of the blades are tilted inwardly towards each other and thereby intercept the lower end of the ice rod 84. This limits the downward movement of the ice rod.

When the crank arm 74 is pivoted in the opposite direction, the blades 76 pivot towards each other as shown in FIG. 10 severing or cutting the ice into a discreet chunk 88 which may be a cube, if the length of the chunk is substantially equal to the ice rod cross-sectional width. It can be seen that the length of the chunk formed can be controlled by the geometrical dimensioning of the cutter guides 82 so that the amount of the ice rod 84 which extends past the cutter edges when the cutter is opened is that which is desired for the length of the ice chunk. When the cutter blades are reciprocated back to the position as shown in FIG. 9 the ice rod 84 is free to fall downwardly, which it does and the sequence is repeated until the full length of the ice rod 84 passes out the lower end 86 of each of the tubes 28 and is cut into uniform length chunks.

As seen in FIG. 7 the most left-hand cutter edge 78A and the most right-hand cutter edge 78B are not employed in cutting ice and these portions could be eliminated however for uniformity of parts they can be configured like the other cutters 78.

In order to effectively harvest the ice it must not be permitted to pass downwardly into the water collection chamber 62. This is achieved by pivoting baffle 74 to the position shown in FIG. 2. As the discreet chunks of ice 88 pass downwardly past the cutters 76 they are guided by plates 58 and 60 to pass onto baffle 64 and from thence onto stationery baffle 90 out the rearward end of the housing 20. The ice chunks 80 may then be discharged onto a conveyor or other mechanism (not shown) to carry the chunks to storage or for bagging as is commonly employed in the distributing of ice through retail outlets.

Figure 2A:
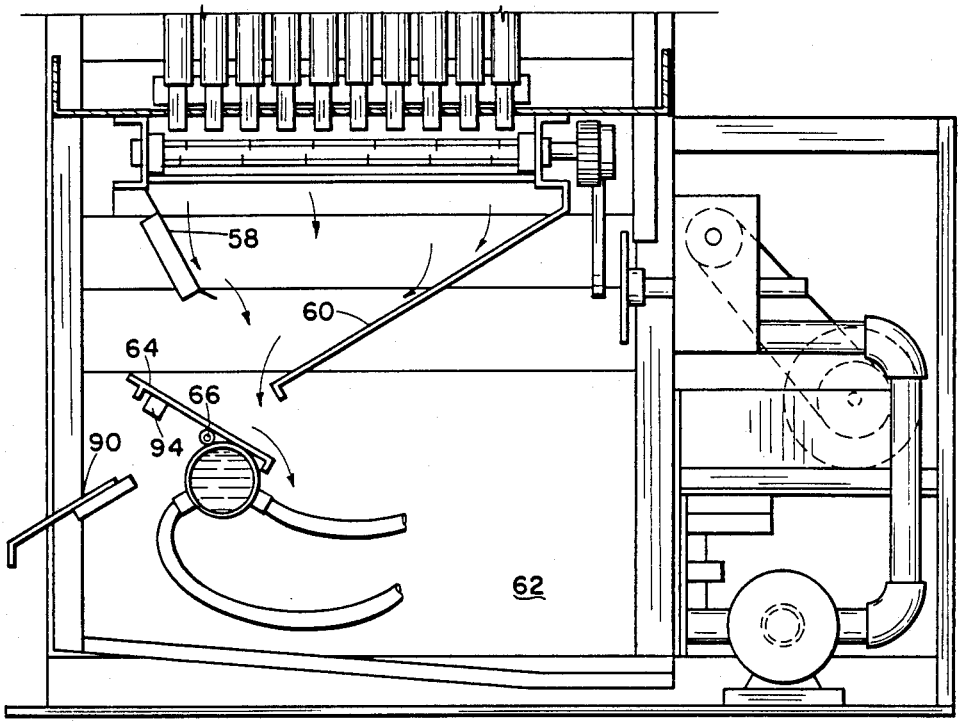
FIG. 2A is a fragmentary elevational cross-sectional view showing the lower portion of FIG. 2 and showing the mode of the machine during the time when ice is being manufactured and the baffle is pivoted to the position to direct the flow of water passing from the chilled tubes into a lower water collection chamber in the system for recycling.

The pivoting baffle 64 thus serves to control the passage of ice during harvesting and to direct water into the collection chamber 62 during ice making. The baffle 64 may be pivoted in a variety of ways such as use of an electrical solenoid, electric motor, pneumatic device or others. A unique and automatic means of controlling the position of baffle 64 is illustrated in FIGS. 2 and 2A wherein the baffle has attached to it a tank 92. The baffle 64 is arranged such that when tank 92 is empty the baffle automatically pivots to the position shown in FIG. 2. This can be arranged by providing a weight 94 to counterbalance the weight of the tank 92 or by the use of a spring (not shown). Weight 94 is merely emblematic of the construction of the baffle 64 with tank 92 attached so that when tank 92 is empty the baffle is biased by gravity to pivot to the ice discharge position of FIG. 2.

When an ice manufacturing sequence begins water must be moved into the water discharge manifold 36 above the tubes. This may be accomplished by flowing water by means of flexible hoses 96 and 98 through the tank 20. The inlet hose 98 connects preferably with the bottom of the tank 92 and outlet hose 96 with the top. When a pump (not shown) is actuated to initiate the flow of water from the reservoir 62 to the water discharge manifold 36, the water flows through the flexible hose 98, filling the tank 92 and, when the tank is filled, flows out through hose 96 and upwardly through piping into the water distribution manifold 36. When water fills the tank 92 the weight thereof automatically tilts it to the position shown in FIG. 2A. Since water is circulated continuously during the ice making mode the pivoted baffle 94 will remain in the position shown directing water into the collection chamber 62.

As soon as the ice making mode terminates the flow of water is discontinued. When this happens water is permitted to drain from tank 92 back into the collection chamber 62. This will take a few seconds, after which the pivoting baffle 94 will return to the position shown in FIG. 2. This small delay is not disadvantageous however since it takes some time after the harvesting cycle begins before tubes 28 are heated sufficiently to cause the release of the rods of ice. While this heating process is taking place water drains from tank 92 and baffle 64 returns to the position of FIG. 2 so that thereafter, as the chunks of ice 88 fall downwardly past the cutting blades 96 they are directed onto the stationery baffle 90 and out of the machine.

The invention described fulfills all of the initial objectives and provides a unique and highly improved ice making machine for making discreet chunks of ice. An advantage of the machine is that the chunks can be made to be uniform and of highly desireable cube or cylindrical arrangements preferred by ice consumers. At the same time the efficiency of the ice making process is improved over known techniques because of the unique arrangement of the expansion chambers in the annular areas between the interior of the shells and the exterior of the tubes.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. Apparatus for manufacturing ice, comprising:

at least one elongated vertical tube having upper and lower ends;

means for chilling said tube;

means for flowing water into the upper end of said tube whereby a rod of ice is formed in said tube;

means for heating said tube to release a rod of ice to pass downwardly out said tube lower end; and baffle means below said tube and having a first mode for conducting water flowing from the lower end of said tube into a water collection chamber and having a second mode for directing ice released from said tube onto an ice delivery chute and means coupled to said water flowing means for placing said baffle means in its first mode when water is being delivered and in its second mode upon cessation of said water delivery.

2. The apparatus for manufacturing ice according to claim 1 wherein said baffle means is supported for pivotal movement about a horizontal axis, and including means coupled to said water flowing means to pivot said baffle means in one direction to deflect water into said collection chamber while water is flowing to said tube and in another direction to conduct ice onto said delivery chute when said water flow is terminated.

3. The apparatus for manufacturing ice according to claim 2 wherein said means to pivot said baffle includes a tank secured to said baffle, said baffle being biased to normally take the position to conduct ice onto said delivery chute, and including means to flow water into said tank to cause said baffle to pivot to the position to cause it to deflect water into said collection chamber.

4. Apparatus for manufacturing ice, comprising:

at least one vertical ice forming means having upper and lower ends and first and second heat exchange surfaces;

means for chilling one surface of said ice forming means means for flowing water to the upper end of said ice forming means whereby ice is formed on the other surface thereof, means of heating said ice forming means to release said ice to pass downwardly therefrom, baffle means below said ice forming means and having a first mode for conducting water flowing from the lower end of said ice forming means into a water collection chamber and having a second mode for directing ice released from said ice forming means into an ice delivery chute and means coupled to said water flowing means for placing said baffle means in its first mode when water is being delivered and in its second mode upon the cessation of said water delivery.

5. The apparatus for manufacturing ice according to claim 4 wherein said baffle means is supported for pivotal movement about a horizontal axis, and including means coupled to said water flowing means to pivot said baffle means into a first position to deflect water into said collection chamber when water is flowing to said ice forming means and to a second position to conduct ice onto said delivery chute when said water flow is terminated.

6. The apparatus for manufacturing ice according to claim 5 wherein said means to pivot said baffle means includes a tank secured to said baffle means, said baffle means being biased to normally take the position to conduct ice onto said delivery chute, and including means to flow water into said tank to cause said baffle means to pivot to the position to cause it to deflect water into said collection chamber.

7. Apparatus for manufacturing ice comprising:

a plurality of elongate vertical tubes having upper and lower ends and means for chilling said tubes, means for flowing water downwardly through said tubes while chilled to cause a rod of ice to form in said tubes, means for heating said tubes to cause the release of the rods of ice formed in said tubes to move downwardly out of the lower ends of said tubes, baffle means disposed below said tubes, said baffle means having a first position for conducting water flowing from the lower ends of said tubes into a water collection chamber and a second position for directing ice released from said tubes onto an ice delivery chute, and means operative when water is flowing downwardly through said tubes to move said baffle means to its first position and upon the termination of water flow downwardly through said tubes for moving said baffle to its second position.

8. The apparatus set forth in claim 7 wherein said baffle means comprises a baffle supported for pivotal movement about a horizontal axis, and means for pivoting said baffle to its first position to deflect water into said collection chamber upon the delivery of water to said tubes and for pivoting said baffle to its second position to conduct ice into said delivery chute when delivery of water to said tubes is terminated.

9. The apparatus set forth in claim 8 wherein said baffle pivoting means includes a tank secured to said baffle said baffle being biased to its second position, and means for conducting water to said tank to cause the baffle to pivot to its first position upon delivery of water to said tubes.

* * * * *